US007635064B2

(12) United States Patent
Wang

(10) Patent No.: US 7,635,064 B2
(45) Date of Patent: Dec. 22, 2009

(54) COLLAPSIBLE BASKET

(76) Inventor: Wen-Tsan Wang, 6F., No. 300, Jui Kuang, Taipei (TW)

( * ) Notice: Subject to any disclaimer, the term of this patent is extended or adjusted under 35 U.S.C. 154(b) by 400 days.

(21) Appl. No.: 11/567,226

(22) Filed: Dec. 6, 2006

(65) Prior Publication Data

US 2008/0135549 A1 Jun. 12, 2008

(51) Int. Cl.
*A45C 7/00* (2006.01)
*A45C 13/04* (2006.01)
*A45C 13/26* (2006.01)

(52) U.S. Cl. ..... 220/9.2; 220/9.4; 220/4.28; 220/6

(58) Field of Classification Search ..... 220/1.5, 220/1.6, 4.28, 4.33, 4.34, 6, 7, 9.1, 9.2, 9.4, 220/485, 666, 668; 403/274, 276–279, 281, 403/282, 285

See application file for complete search history.

(56) References Cited

U.S. PATENT DOCUMENTS 5,746,140 A * 5/1998 Flood ..... 109/50
6,230,915 B1 * 5/2001 Liu ..... 220/6
6,409,076 B1 * 6/2002 Wang ..... 229/122.34
6,508,376 B1 * 1/2003 Chiang ..... 220/485

* cited by examiner

*Primary Examiner*—Anthony Stashick
*Assistant Examiner*—Madison L Wright
(74) *Attorney, Agent, or Firm*—Leong C. Lei

(57) ABSTRACT

A collapsible basket having a collapsible basket body made of a soft cloth material, a hard bottom board mounted inside the collapsible basket body and supported on the rectangular horizontal bottom panel of the collapsible basket body, and a folding support frame, which has a rectangular top open frame affixed the topmost edge of the collapsible basket body and two leg members pivotally coupled to the two opposite short sides of the rectangular top open frame for engaging to respective positioning holes on the hard bottom board to support the rectangular top open frame above the hard bottom board and to further stretch the collapsible basket body in shape for holding things.

4 Claims, 7 Drawing Sheets

COLLAPSIBLE BASKET

BACKGROUND OF THE INVENTION (a) Technical Field of the Invention

The present invention relates a basket and more particularly, to a collapsible basket.

(b) Description of the Prior Art

In order to save storage space, various commercial collapsible storage baskets are created. A collapsible storage basket is known a fabric basket body, a plurality of horizontal top rods and horizontal bottom rods respectively horizontally fastened to the top and bottom sides of the vertical peripheral panels of the fabric basket body, and a plurality of vertical rods respectively vertically fastened to the junction between each two vertical peripheral panels of the fabric basket body. Further, each vertical peripheral panel of the fabric basket body has crossed folding lines. If the storage basket is not in use, the user can twist the horizontal top rods relative to the horizontal bottom rods to collapse the storage basket.

The aforesaid conventional collapsible storage basket is functional, however it has a complicated structure, resulting in a high manufacturing cost.

SUMMARY OF THE INVENTION

The primary purpose of the present invention is to provide a collapsible basket, which has a simple structure and is easily collapsible. It is another object of the present invention to provide a collapsible basket, which is inexpensive to manufacture.

To achieve these and other objects of the present invention, the collapsible basket comprises a collapsible basket body made of a soft cloth material, a hard bottom board mounted inside the collapsible basket body and supported on the rectangular horizontal bottom panel of the collapsible basket body, and a folding support frame mounted inside the collapsible basket body and adapted to support the collapsible basket body in shape for holding things. The collapsible basket body has a rectangular horizontal bottom panel and four rectangular vertical peripheral panels joined to one another and extending around the four sides of the rectangular horizontal bottom panel and defining with the rectangular horizontal bottom panel a rectangular top-open holding space. The hard bottom board has a plurality of top positioning holes arranged near the border thereof. The folding support frame comprises a rectangular top open frame fastened to the topmost edge of each of the four rectangular vertical peripheral panels of the collapsible basket body, and a plurality of leg members respectively pivoted to the rectangular top open frame for engaging into the positioning holes to support the rectangular top open frame above the hard bottom board and to further stretch the collapsible basket body into shape.

Further, the leg members two top ends respectively provided with a barrel that is pivotally coupled to the rectangular top open frame. The barrels may be directly welded to the top ends of the leg members. Alternatively, the barrels can be respectively fastened to the top ends of the leg members by a rivet joint.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
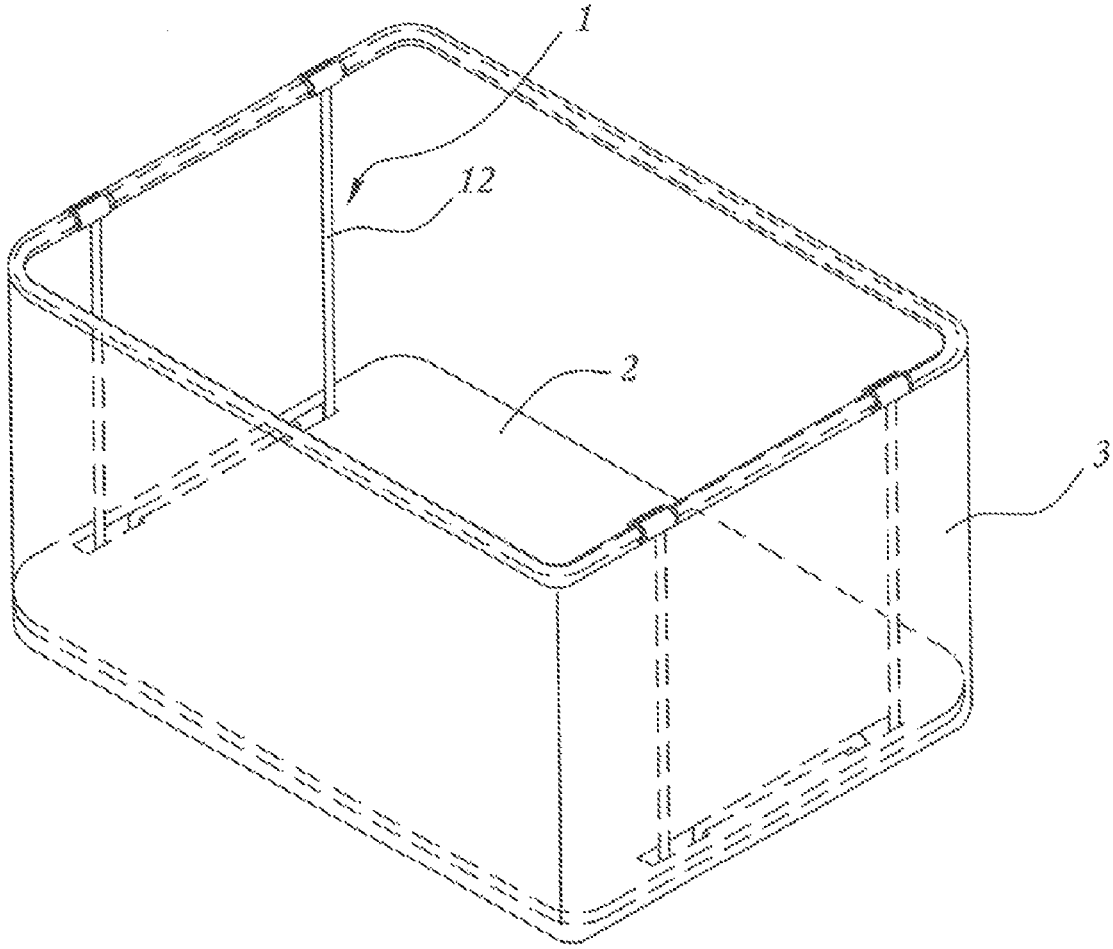
FIG. 1 is a perspective view of a collapsible basket in accordance with the present invention.
Figure 2:
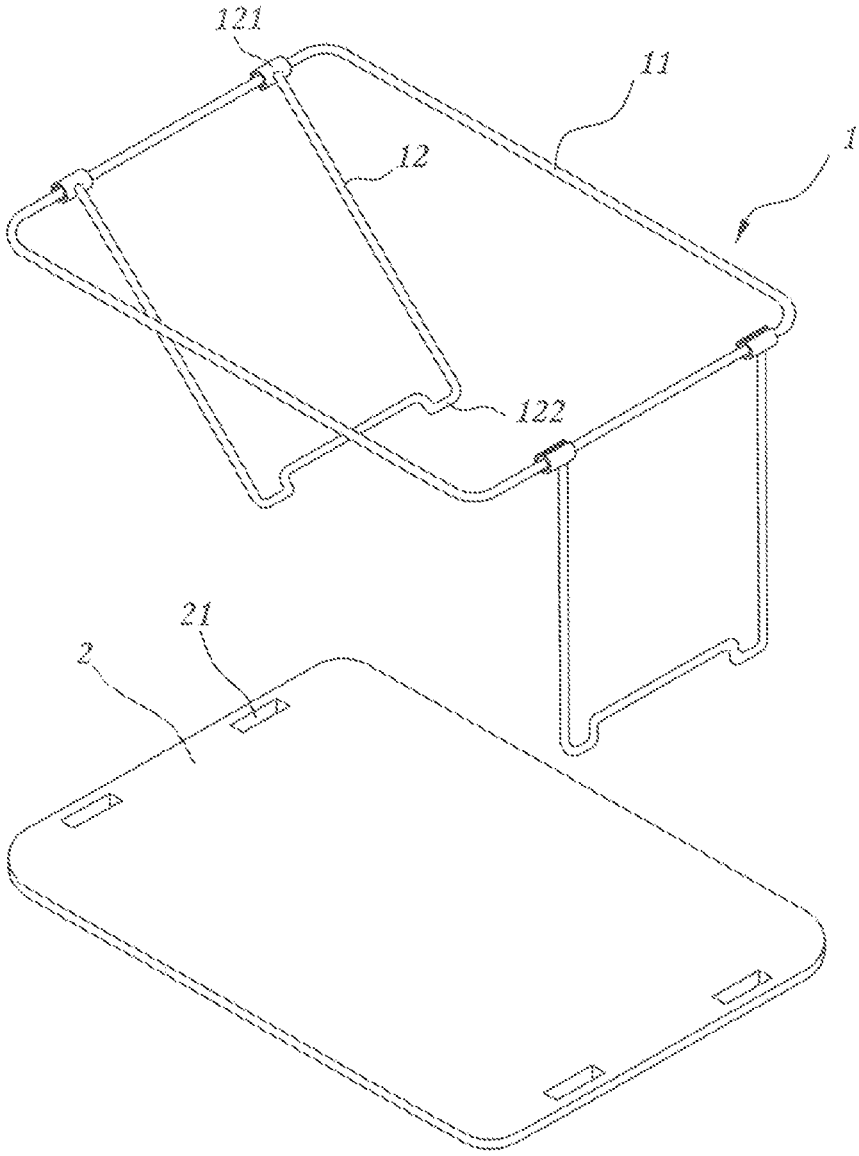
FIG. 2 is an exploded view of the collapsible basket according to the present invention (the fabric basket body excluded).
Figure 3:
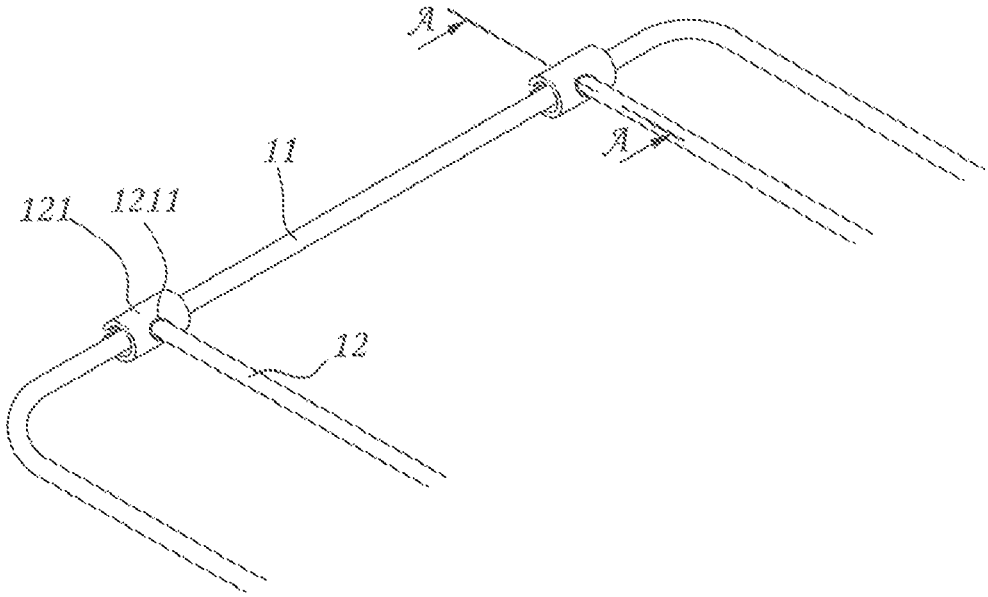
FIG. 3 is an enlarged view of a part of the folding support frame of the collapsible basket according to the present invention.

Referring to FIGS. 1-3, a collapsible basket in accordance with the present invention is shown comprised of a folding support frame 1, a bottom board 2, and a rectangular basket body 3.

Referring to FIG. 2, the folding support frame 1 comprises a rectangular top open frame 11 and two leg members 12 respectively pivoted to two opposite sides of the rectangular top open frame 11. Bending a metal wire rod of a predetermined diameter into shape respectively forms the rectangular top open frame 11 and the leg members 12. The leg members 12 have a length not less than the depth of the inside space of the basket body. Each leg member 12 has two barrels 121 respectively provided at the two top ends 1211 thereof and horizontally aligned in a line and coupled to the rectangular top open frame 11 and two leg members 12 respectively pivoted to two opposite sides of the rectangular top open frame 11, and two protruding positioning portions 122 disposed at the bottom side.

Figure 3A:
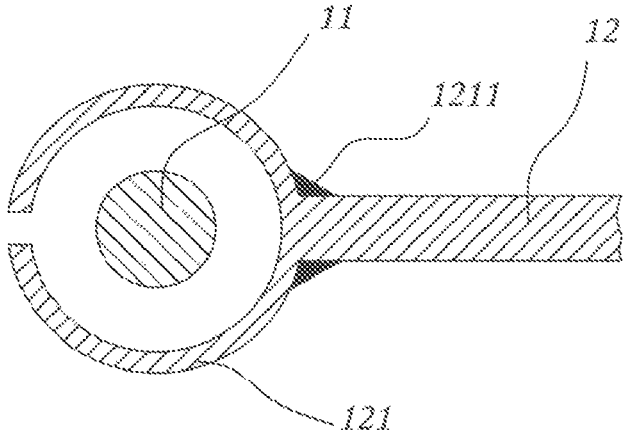
FIG. 3A is a sectional view in an elarged scale taken along line A-A of FIG. 3.
Figure 4:
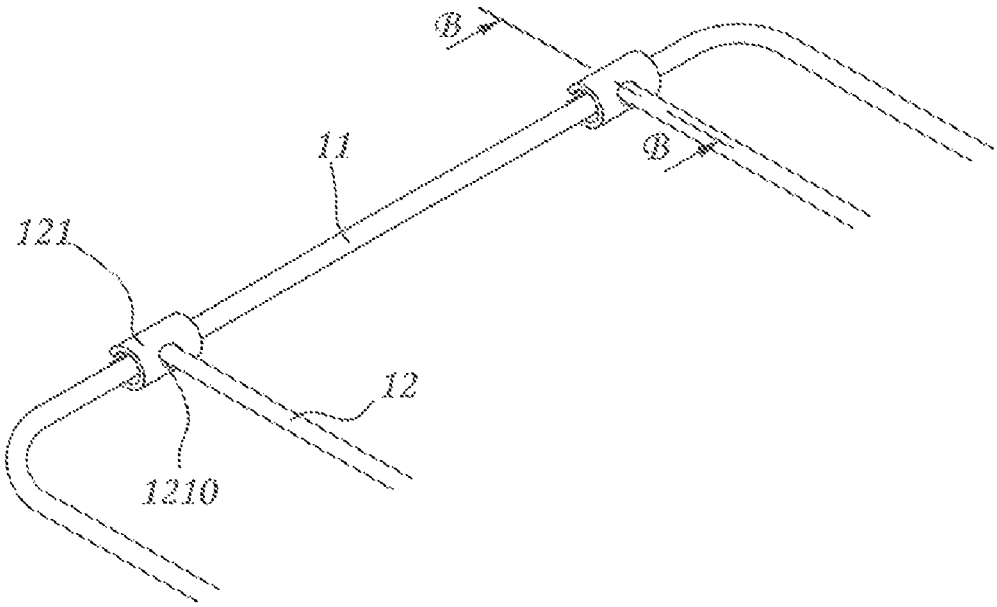
FIG. 4 corresponds to FIG. 3, showing an alternate form of the folding support frame.
Figure 4A:
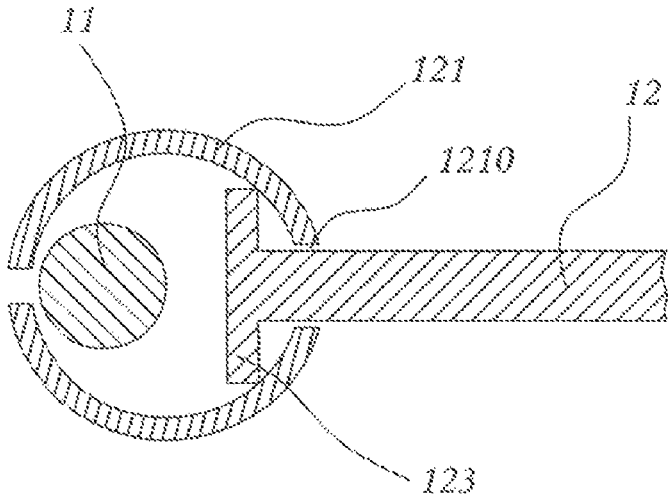
FIG. 4A is a sectional view in an enlarged scale taken along line B-B of FIG. 4.

The connection structure between the barrels 121 and the leg members 12 may be variously embodied. According to the embodiment shown in FIGS. 4 and 4A, each barrel 121 has a transverse through hole 1210; each top end of each leg member 12 is inserted through the transverse through hole 1210 of the associating barrel 121, having an expanded end block 123 stopped inside the associating barrel 121. According to the embodiment shown in FIGS. 3 and 3A, each leg member 12 has its each top end 1211 respectively welded to the associating barrels 121. Further, the barrels 121 are made of a respective metal plate, which is curved into a cylindrical shape after connection of the associating leg member 12.

The bottom board 2 is a hard board, having two pairs of top positioning holes 21 formed on the top wall near two distal ends respective for receiving the protruding positioning portions 122 of the leg members 12. Further, the positioning holes 21 can be through holes cut through the top and bottom sides of the bottom board 2. Alternatively, the positioning holes 21 can be blind holes formed on the top wall of the bottom board 2.

The rectangular basket body 3 is made of a soft fabric material, having a rectangular horizontal bottom panel and four rectangular vertical peripheral panels joined to one another and extending around the four sides of the rectangular horizontal bottom panel and defining with the rectangular horizontal bottom panel a rectangular top-open holding space. The folding support frame 1 is inserted into the rectangular top-open holding space of the rectangular basket body 3. After insertion of the folding support frame 1 into the rectangular top-open holding space of the rectangular basket body 3, the top side of the joined four rectangular vertical peripheral panels of the rectangular basket body 3 is wrapped about the rectangular top open frame 11 and fastened thereto with stitches.

Figure 5:
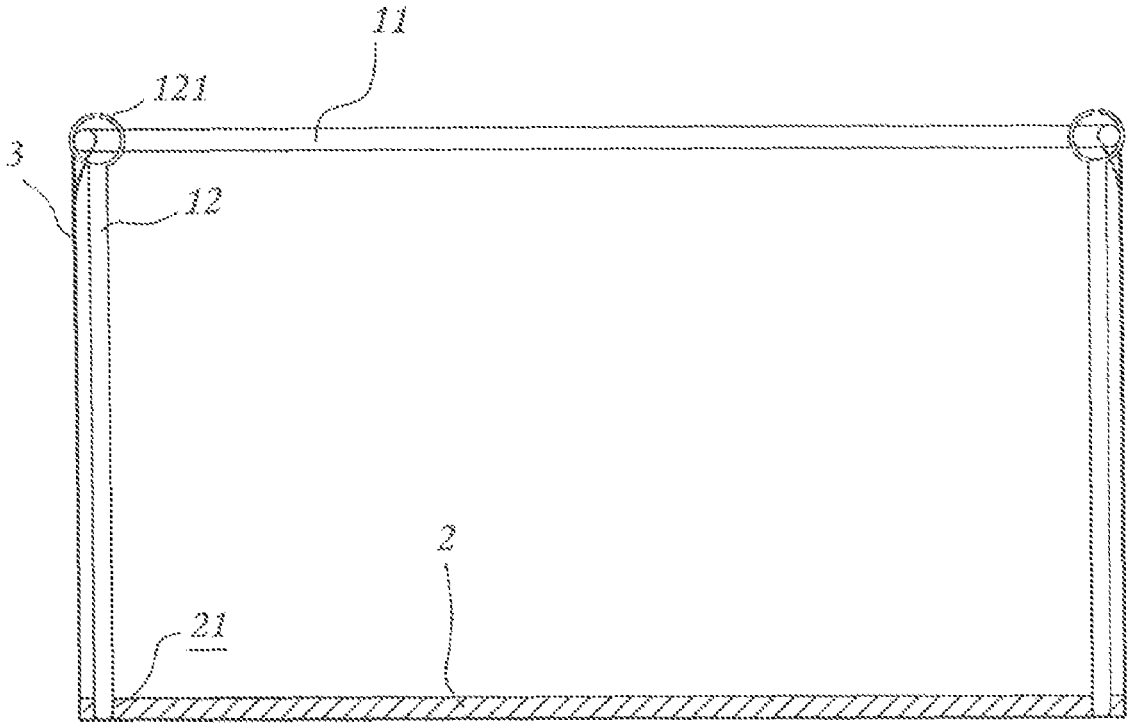
FIG. 5 is a side plain view of the present invention, showing the extended status of the collapsible basket.

Referring to FIG. 5 and FIG. 1 again, when in use, the two leg members 12 of the folding support frame 1 are respectively extended out to force the respective protruding positioning positions 122 into the respective positioning holes 21, thereby holding the folding support frame 1 in the extended position to support the rectangular basket body 2 in shape.

Figure 6:
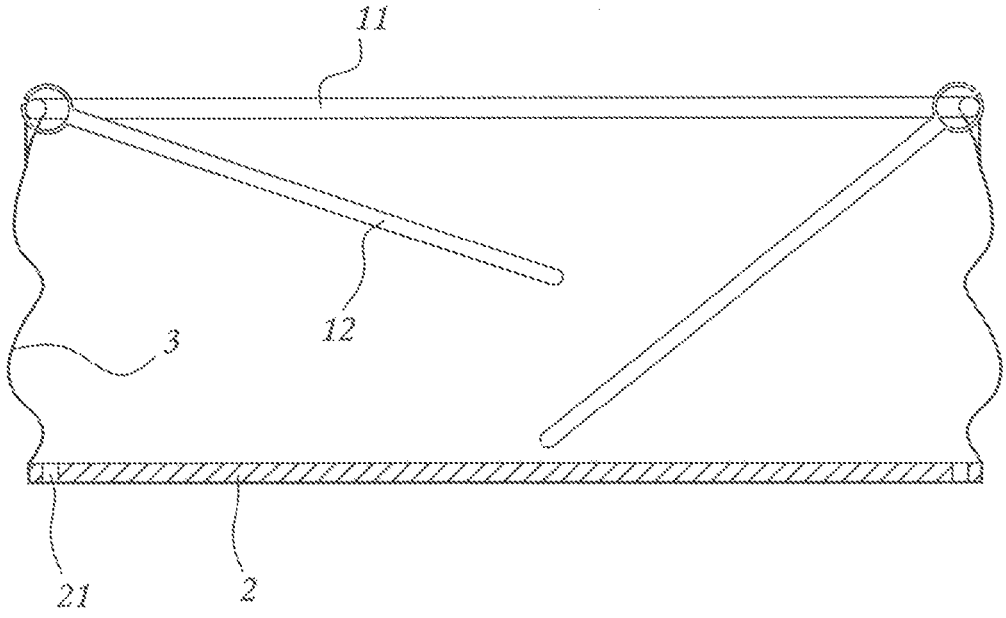
FIG. 6 is a schematic side view of the present invention, showing the leg members disengaged from the bottom board.
Figure 7:
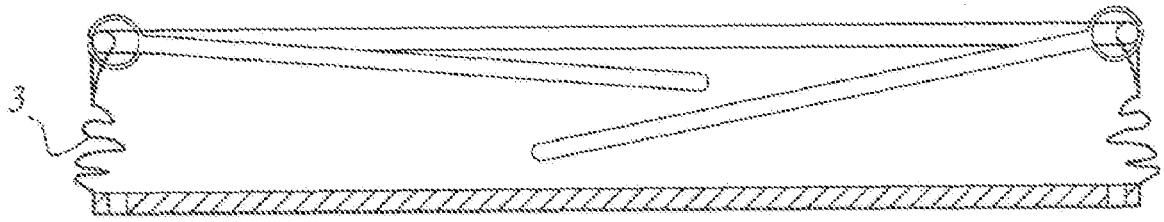
FIG. 7 is a schematic side view showing the collapsed status of the collapsible basket according to the present invention.

Referring to FIGS. 6 and 7, when not in use, the leg members 12 are pulled away from the bottom board 2 to disengage the positioning portions 122 from the respective positioning holes 21 and received to the inside of the rectangular top open frame 11, so that the rectangular basket body 3 is collapsed, and the collapsible basket is arranged into a flat shape.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A collapsible basket comprising:

a collapsible basket body made of a soft cloth material, said collapsible basket body having a rectangular horizontal bottom panel and four rectangular vertical peripheral panels joined to one another and extending around the four sides of said rectangular horizontal bottom panel and defining with said rectangular horizontal bottom panel a rectangular top-open holding space;

a hard bottom board mounted inside said collapsible basket body and supported on the rectangular horizontal bottom panel of said collapsible basket body, said hard bottom board having a plurality of top positioning holes arranged near the border thereof; and a folding support frame mounted inside said collapsible basket body and adapted to support said collapsible basket body in shape for holding things, said folding support frame comprising a rectangular top open frame fastened to a topmost edge of each of the four rectangular vertical peripheral panels of said collapsible basket body, and two leg members respectively pivoted to said rectangular top open frame for engaging into the positioning holes to support said rectangular top open frame above said hard bottom board and to further stretch said collapsible basket body into shape, each of said leg members having a top end and a barrel respectively provided at said top end and pivotally coupled to said top open frame, said barrel having a transverse through hole, said top end of said leg members being inserted through said transverse through hole of said barrel and having an expanded end block stopped inside said barrel, said barrel being made of a respective metal plate which is curved into a cylindrical shape after connection of a respective one of said leg members.

2. The collapsible basket as claimed in claim 1, wherein said positioning holes of said hard bottom board are blind holes.

3. The collapsible basket as claimed in claim 1, wherein said leg members are respectively pivoted to two opposite short sides of said rectangular top open frame.

4. The collapsible basket as claimed in claim 1, wherein said positioning holes of said hard bottom board are through holes cut through top and bottom sides of said hard bottom board.

* * * * *